US007892020B2

(12) United States Patent
Igarashi

(10) Patent No.: US 7,892,020 B2
(45) Date of Patent: Feb. 22, 2011

(54) ELECTRIC WIRE CONNECTION STRUCTURE HAVING A MOLD UNIT HOLE

(75) Inventor: Isao Igarashi, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 78 days.

(21) Appl. No.: 12/282,458

(22) PCT Filed: Mar. 2, 2007

(86) PCT No.: PCT/JP2007/053998

§ 371 (c)(1),
(2), (4) Date: Dec. 3, 2008

(87) PCT Pub. No.: WO2007/105501

PCT Pub. Date: Sep. 20, 2007

(65) Prior Publication Data

US 2009/0247003 A1 Oct. 1, 2009

(30) Foreign Application Priority Data

Mar. 10, 2006 (JP) ..... 2006-065809

(51) Int. Cl.
*H01R 12/24* (2006.01)

(52) U.S. Cl. ..... 439/495; 439/607.49

(58) Field of Classification Search ..... 439/493, 439/495, 499, 607.49, 607.41, 607.47, 607.48, 439/607.5

See application file for complete search history.

(56) References Cited

U.S. PATENT DOCUMENTS 3,744,128 A * 7/1973 Fisher et al. ..... 29/858
4,602,831 A * 7/1986 Lockard ..... 439/108
4,737,117 A * 4/1988 Lockard ..... 439/92
4,846,724 A * 7/1989 Sasaki et al. ..... 439/607.41
5,848,914 A * 12/1998 Lang et al. ..... 439/607.47
6,203,333 B1 * 3/2001 Medina et al. ..... 439/76.1
6,336,827 B1 * 1/2002 Akama et al. ..... 439/607.46
6,705,894 B1 * 3/2004 Comerci et al. ..... 439/607.47
6,764,342 B2 * 7/2004 Murayama et al. ..... 439/607.1
7,223,915 B2 * 5/2007 Hackman ..... 174/36
7,267,575 B1 * 9/2007 Hwang ..... 439/497

FOREIGN PATENT DOCUMENTS

| | | |
|---|---|---|
| JP | 50-47189 | 4/1975 |
| JP | 4-51779 | 4/1992 |
| JP | 10-119062 | 5/1998 |
| JP | 2005-190717 | 7/2005 |
| JP | 2005-259560 | 9/2005 |
| JP | 2006-012744 | 1/2006 |

* cited by examiner

*Primary Examiner*—Hae Moon Hyeon
(74) *Attorney, Agent, or Firm*—Barley Snyder, LLC

(57) ABSTRACT

An electric flat cable wire connection structure for connecting to a mating connector has a plurality of individual electric wires, a plate-shaped intermediate member, a contact part, and a coupler. The plurality of individual electric wires are arranged in a row. The plate-shaped intermediate member has an electric wire connecting part to which the respective ends of the plurality of individual electric wires are connected. The contact part is received by the mating connector. The coupler grasps the intermediate member to which the plurality of individual electric wires are connected for guiding the intermediate member to a predetermined position of the mating connector.

5 Claims, 8 Drawing Sheets

FIG. 4A
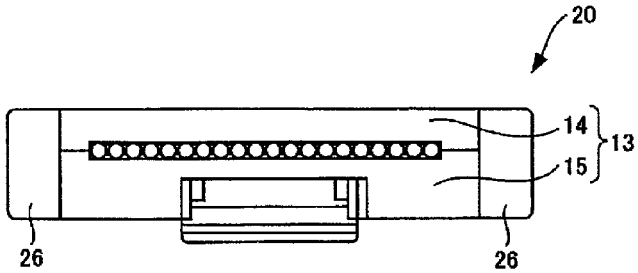
FIG. 4B
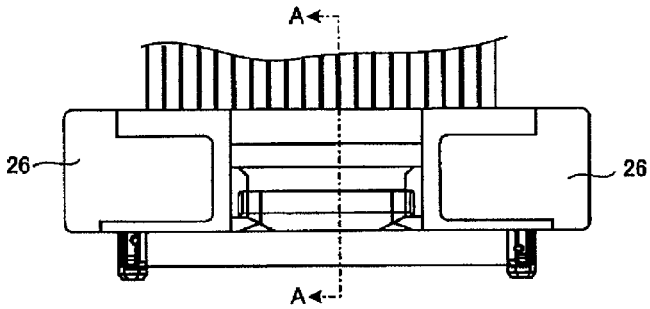
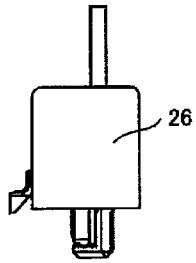
FIG. 4E
FIG. 4C
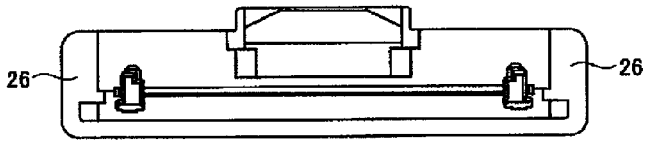
FIG. 4D
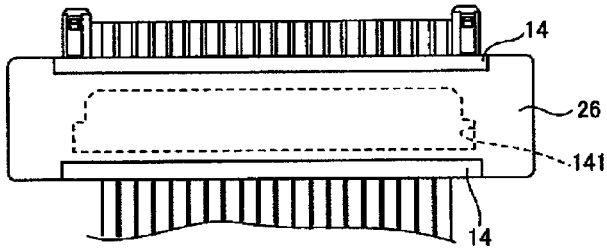

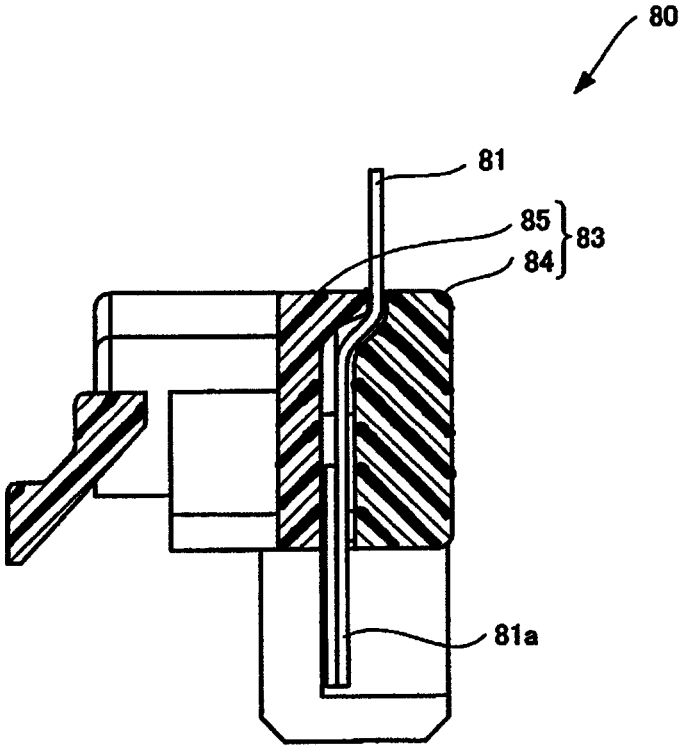
FIG. 9
PRIOR ART
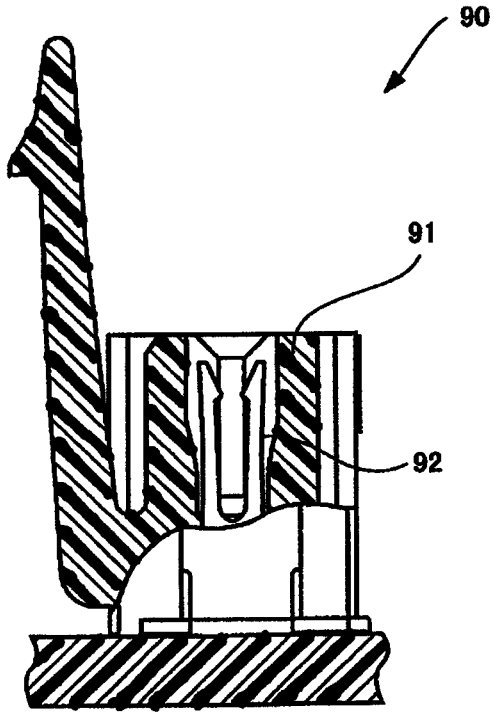

ELECTRIC WIRE CONNECTION STRUCTURE HAVING A MOLD UNIT HOLE

CROSS-REFERENCE TO RELATED APPLICATIONS

This application is a National Stage Application filed under 35 U.S.C. §371 of PCT International Application No. PCT/JP2007/053998, filed on Mar. 2, 2007, which claims priority to Japanese Patent Application No. 2006-065809, filed Mar. 10, 2006.

FIELD OF THE INVENTION

The present invention relates to an electric wire connection structure for collectively connecting a plurality of individual electric wires to the mating connector for a flat cable.

BACKGROUND

Connecting flat cables exemplified by flexible printed circuits (FPC) and the like to a circuit board via a connector has been widely performed. This kind of connector is normally mounted on the circuit board and has a housing for receiving the flat cable and contacts which are held in the housing. To connect the flat cable to the connector, it is necessary to push the flat cable grasped by a worker or the like inside the housing of the connector, but a flat cable is flexible, so handling it is difficult. To improve connection workability, a flat cable connection structure gripped by a coupler made of an insulative material at the part near the tip of the flat cable has been proposed.

FIG. 9 is a cross section diagram showing the prior art flat cable connection structure together with the mating connector.

The flat cable connection structure 80 shown in FIG. 9 has a flat cable 81, and a coupler 83 consisting of a first coupler member 84 and a second coupler member 85, and the flat cable 81 gripped by the first coupler member 84 and the second coupler member 85 in a state in which the tip part 81*a* is projecting from the coupler 83. Meanwhile, the flat cable connector 90 which is the mating connector is equipped with a housing 91 which receives the flat cable 81 and a contact 92 held inside the housing 91. With the flat cable connection structure 80 of FIG. 9, by a worker or the like grasping the coupler 83, for example, the flat cable 81 is held with equal force. Then, by inserting the tip part 81*a* of the flat cable 81 inside the housing 91, the conductor of the flat cable 81 contacts the contact 92 of the flat cable connector 90. In this way, the flat cable 81 is held via the coupler 83, so the connection workability is improved. Also, as the workability improves, the flat cable 81 is securely connected to the flat cable connector 90 without buckling, and with prevention of a partial engagement. Also, it is also possible to form a lock that engages with the flat cable connector 90, so this prevents falling out after the connection of the flat cable 81.

However, there are cases where it is necessary to connect electric wires other than the flat cable to the circuit board on which the flat cable connector is mounted according to the type or status of the device in which this circuit board is incorporated, and among these, there are many cases where it is necessary to connect commonly used individual electric wires. Here, for example, in JP 2006-12717A, is shown a connector for which both the FPC, which is one type of flat cable, and individual electric wires are connected to the circuit board. This connector consists of a wiring side connector for holding both the plurality of terminals connected to the plurality of individual electric wires and the FPC by using the housing, and a board side connector which has the mating terminals corresponding to the connector terminals on the wiring side, and by engagement of the wiring side connector and the board side connector, the board's electric wires are electrically connected to the terminals of the connector on the wiring side.

However, with the connector indicated in JP 2006-12717A, it is necessary for the board-side connector which is the mating connector to have a concave part for mating formed according to the shape of the terminal of the connector on the wiring side. Also, the structure of the wiring-side connector becomes complex because a plurality of terminals corresponding to the plurality of individual electric wires is held in the housing.

SUMMARY

In view of the circumstances noted above, an object of the present invention is to provide an electric wire connection structure with a simple structure for which it is possible to connect a plurality of individual electric wires to the mating connector for the flat cable.

The electric wire connection structure of the present invention for achieving the object noted above is an electric wire connection structure for collectively connecting a plurality of individual electric wires to the mating connector for a flat cable, comprising: a plurality of individual electric wires arranged in a row, a plate-shaped intermediate member which has an electric wire connecting part to which the respective ends of the plurality of individual electric wires are connected, and a contact part received by the mating connector, and a coupler that grasps the intermediate member to which the plurality of individual electric wires are connected, for guiding the intermediate member to a predetermined position of the mating connector.

With the electric wire connection structure of the present invention, the constitution is such that the plate-shaped intermediate member for electrically connecting the individual electric wires and the mating connector contact is grasped by the coupler, so the contact part of the intermediate member, just as with a flat cable, is received in the mating connector and makes contact with its contact. Therefore, with the electric wire connection structure of the present invention, it is possible to connect the plurality of individual electric wires to the mating connector for a flat cable with a simple structure without using dedicated terminals or a housing for holding the terminals. Also, even when individual electric wires are connected, changes are not required for the mating connector, so there is no hindrance to connecting the flat cable again afterward.

Here, with the electric wire connection structure of the present invention noted above, it is preferable that the aforementioned coupler be an item that grasps the end part of the insulation covering of the aforementioned individual electric wires.

By the coupler grasping the insulation covering of the individual electric wires, the individual electric wire bending strength increases without a special member for pressing the individual electric wires.

Also, with the electric wire connection structure of the present invention noted above, it is preferable that the coupler be an item for which a concave part or a hole is formed on the side facing the aforementioned electric wire connecting part.

By having a concave part or a hole, the coupler grasps the intermediate member while avoiding the electric wire connecting part, so stress on the connecting part of the individual electric wire and the intermediate member is relieved.

Also, with the electric wire connection structure of the present invention noted above, it is preferable that the aforementioned coupler have a hole formed on the side facing the aforementioned electric wire connecting part, and furthermore, that the electric wire connection structure comprise a mold unit consisting of an insulative material that embeds the aforementioned hole.

The coupler grasps the intermediate member while avoiding the electric wire connecting part, so stress on the connecting part of the individual electric wire and the intermediate member is relieved, and furthermore, by having an insulative material that embeds the hole, the connecting part is protected from the outside. Also, because the end part of the insulation covering of the individual electric wires is grasped by the coupler, it is not necessary to directly grasp the individual electric wires with dies at the manufacturing stage. Therefore, since there is no risk of the insulative material injected into the dies interior protruding from between the dies and the individual electric wires, there is no need for a countermeasure for protrusion of the insulative material. Thus, manufacturing of the electric wire connection structure is easy.

Also, with the electric wire connection structure of the present invention noted above, it is also possible to have the aforementioned coupler be an item for which a concave part is formed on the side facing the aforementioned electric wire connecting part, and furthermore, for which the electric wire connection structure has a filler filled in the aforementioned concave part.

By having the filler filled into the concave part, there is a decrease in the risk of corrosion due to contact of the connection part with air, and of contact between adjacent electric wires.

Also, with the electric wire connection structure of the present invention noted above, it is preferable that the aforementioned individual electric wires be connected by solder to the aforementioned electric wire connecting part.

By using a solder connection, it becomes possible to connect a plurality of individual electric wires to the intermediate member all at once. Also, the insulation covering of the individual electric wires is grasped by the coupler, so the solder connection does not break easily.

Also, with the electric wire connection structure of the present invention noted above, it is preferable that the aforementioned coupler be equipped with a lock unit for engaging with the aforementioned mating connector.

It is possible to prevent the individual electric wires from falling out of the mating connector due to vibration applied from outside and the like.

As described above, with the present invention, an electric wire connection structure that connects a plurality of individual electric wires to the mating connector for a flat cable with a simple structure is realized.

BRIEF DESCRIPTION OF THE DRAWINGS

Hereafter, embodiments of the present invention will be described while referring to the drawings of which:

FIGS. 4 A-E are external views showing the electric wire connection structure of the second embodiment;

DETAILED DESCRIPTION OF THE EMBODIMENT(S)

Figure 1A:
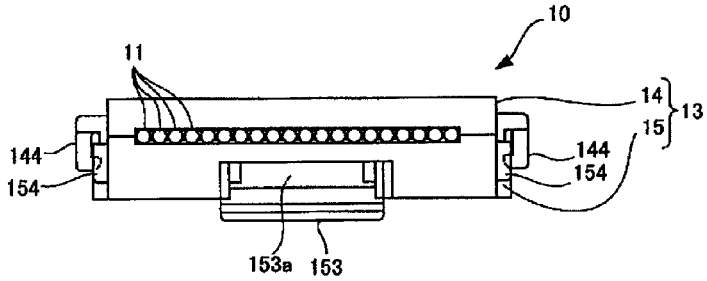
FIGS. 1 A-E are external views showing the electric wire connection structure of the first embodiment of the present invention.
Figure 1B:
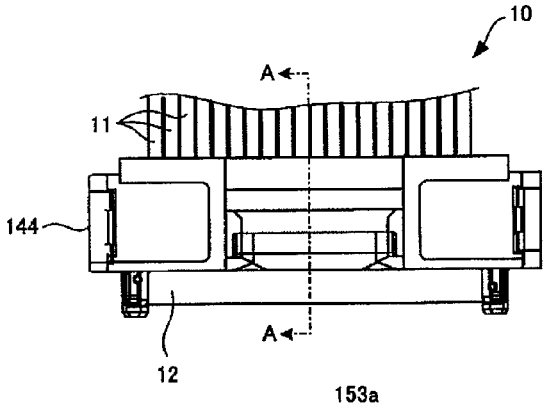
Figure 1E:
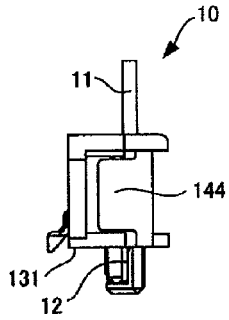
Figure 1C:
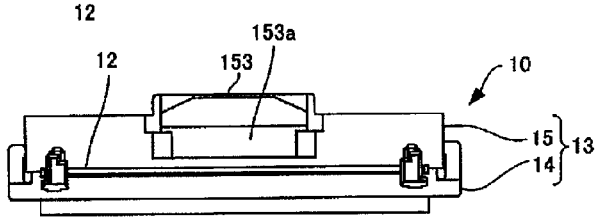
Figure 1D:
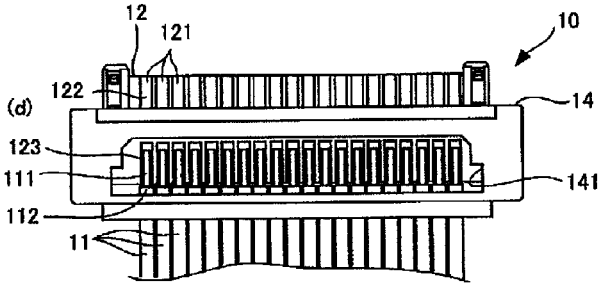
Figure 2:
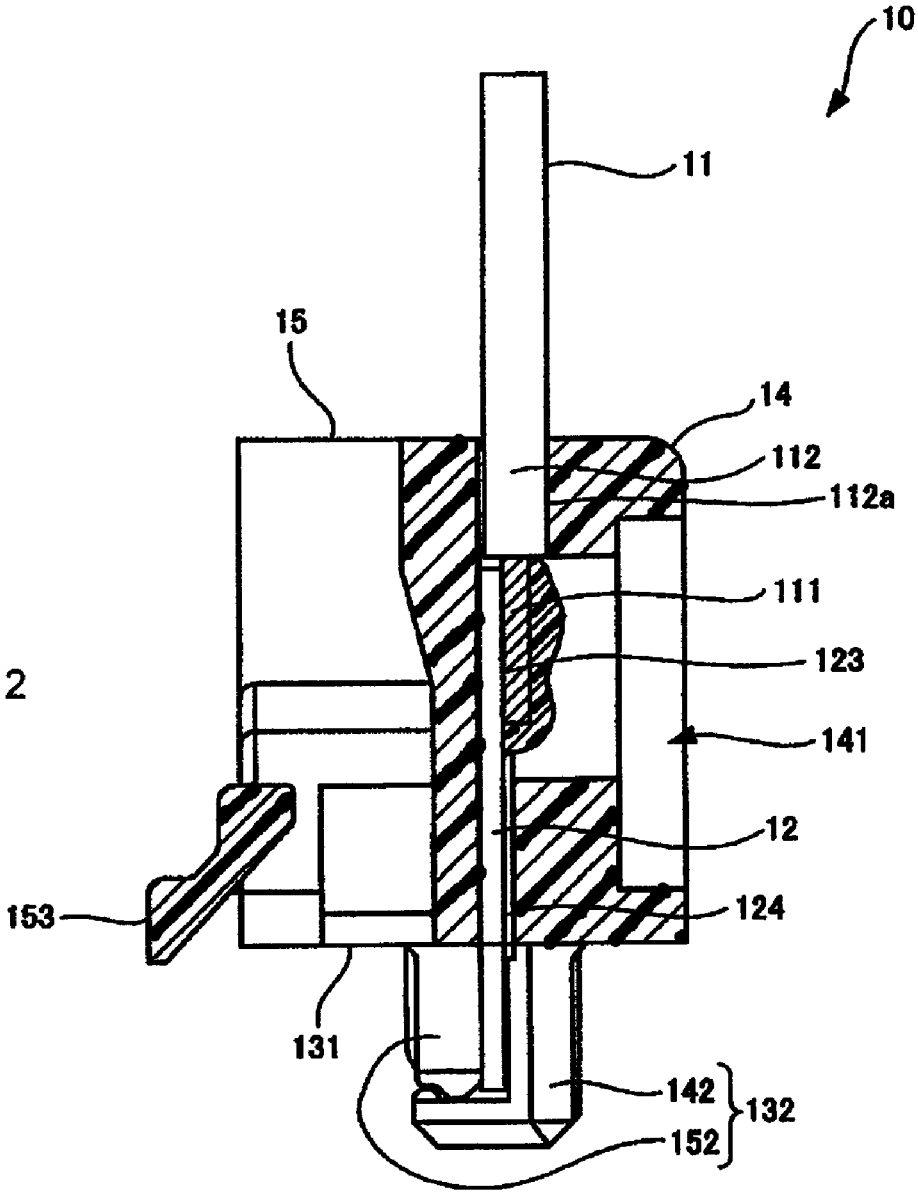
FIG. 2 is the A-A cross section of FIG. 1B.

The electric wire connection structure 10 shown in FIGS. 1 A-E and FIG. 2 is an electric wire connection structure for collectively connecting a plurality of individual electric wires to the mating connector 50 for a flat cable (see FIG. 3), FIG. 1 A shows a plan view of the electric wire connection structure 10 for which the surface in contact with the mating connector 50 is the bottom surface, FIG. 1B shows a front view, FIG. 1C shows a bottom view, FIG. 1D shows the rear view, FIG. 1E shows the right-side view. The electric wire connection structure 10 is constituted from twenty individual electric wires 11, the intermediate member 12 for electrically connecting the individual electric wires 11 and the contact 52 of the mating connector 50 (see FIG. 3), and the coupler 13 for guiding the intermediate member 12.

Each of the individual electric wires 11 is an electric wire consisting of a wire core 111 consisting of a metal material, and an insulation covering 112 formed on the outer periphery of the wire core 111, and at part of the tip, the insulation covering 112 is removed and the wire core 111 is exposed. The twenty individual electric wires 11 are aligned in a row at least in the vicinity of the coupler 13.

Figure 3:
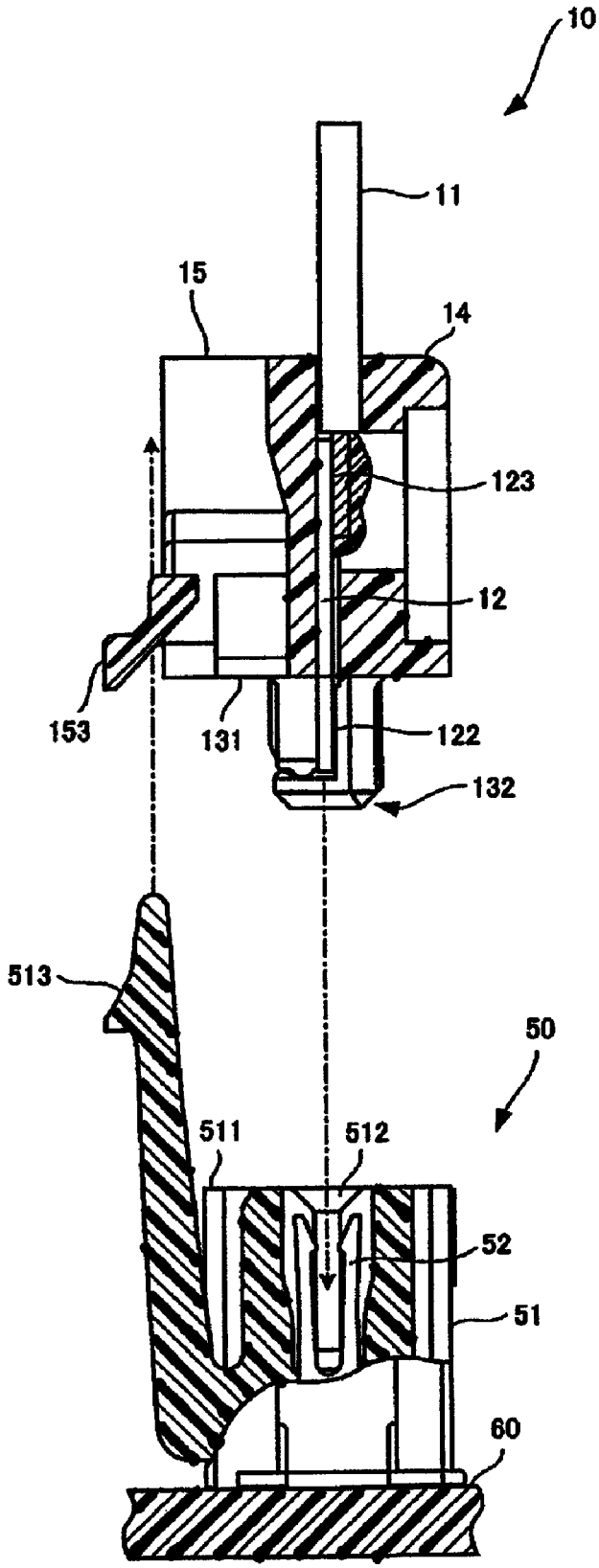
FIG. 3 is a cross sectional view showing the state of the individual electric wires being connected to the mating connector by the electric wire connection structure of FIG. 2.

The intermediate member 12 is a plate-shaped member formed from insulative synthetic resin, and is for electrically connecting the individual electric wires 11 to the contact 52 of the mating connector 50 (see FIG. 3). Twenty straight line wiring patterns 121 consisting of metal material are formed on the surface of one side of the intermediate member 12, and the wiring patterns 121 extend roughly in parallel to each other crossing from one side to the other side of the surface of the intermediate member 12. One end of each of the wiring patterns 121 is received in the housing 51 of the mating connector 50 (see FIG. 3), this is formed as the contact part 122 for contacting the contact 52 (see FIG. 3), and the other end is formed as the electric wire connecting part 123 to which the individual electric wires 11 are connected, and the middle between the contact part 122 and the electric wire connecting part 123 is formed as the middle part 124. The wire core 111 part of the tip of the individual electric wires 11 is connected by solder to the electric wire connecting part 123 of the wiring patterns 121.

The coupler 13 is an item for grasping the intermediate member 12 to which the individual electric wires 11 are connected, and for guiding the intermediate member 12 to a predetermined position of the mating connector 50 (see FIG. 3), and consists of a first coupler member 14 and a second coupler member 15, each formed from an insulative synthetic resin. The coupler 13 grasps the intermediate member 12 and the individual electric wire 11 using the first coupler member 14 and the second coupler member 15. The intermediate member 12 is grasped by the coupler 13 in a state in which the contact part 122 projects from the connector contact surface 131 that contacts the mating connector 50.

The first coupler member 14 has a hole 141 that opens on the side facing the electric wire connecting part 123. This hole 141 is formed so as to not contact the electric wire connecting part 123, and pierces the first coupler member 14. Also, at both ends of the individual electric wires 11 arranged in a row on the first coupler member 14, two engaging pieces 144 that engage with the second coupler member 15 are formed. Also, on the first coupler member 14 are formed two first guide pins 142 that project in the same direction as the direction in which the intermediate member 12 projects from the connector contact surface 131.

On the second coupler member 15 as well, two second guide pins 152 are formed that project in the same direction as the intermediate member 12 projects from the connector contact surface 131, the first guide pin 142 and the second guide pin 152 become a single unit, and the two guide pins 132 that project from the connector contact surface 131 of the coupler 13 are formed. The guide pins 132 are inserted into the mating connector 50 (see FIG. 3) to guide the intermediate member 12 to a predetermined position of the mating connector 50. Also, at both ends of the second coupler member 15 in the direction in which the individual electric wires 11 are aligned, two engagement units 154 are formed to engage with the engaging piece 144 of the first coupler member 14, and furthermore, a lock unit 153 that engages with the mating connector 50 (see FIG. 3) is also provided. When the coupler 13 of the electric wire connection structure 10 is connected to the mating connector 50, the lock arm 513 of the mating connector 50 (see FIG. 3) is inserted in the lock hole 153*a* formed on the second coupler member 15.

Because the hole 141 is formed on the first coupler member 14, the coupler 13 grasps the middle part 124 of the intermediate member 12 and the end part 112*a* of the insulation covering 112 of the individual wires 11 while avoiding the electric wire connecting part 123. Because the coupler 13 grasps the insulation covering 112 of the individual electric wires 11, transmission to the electric wire connecting part 123 of the tensile force applied to the individual electric wires 11 is blocked by the coupler 13, and the solder connection of the individual electric wires 11 and the electric wire connecting part 123 does not break easily. In other words, the bending strength of the individual electric wires 11 increases without a special member for pressing the individual electric wires 11.

The electric wire connection structure 10 shown in FIG. 1 and FIG. 2 is built by, the insulation covering 112 first being removed, the wire cores 111 of the twenty individual electric wires 11 arranged in a row being soldered to the electric wire connecting part 123 of the intermediate member 12, the middle part 124 of the intermediate member 12 and the end part 112*a* of the insulation covering 112 of the individual electric wires 11 next being grasped by the first coupler member 14 and the second coupler member 15, the engaging piece 144 of the first coupler member 14 and the engagement unit 154 of the second coupler member 15 being engaged, and the first coupler member 14 and the second coupler member 15 being fixed.

FIG. 3 is a drawing explaining the state of the individual electric wires 11 being connected to mating connector 50 by the electric wire connecting structure of FIG. 2.

The mating connector 50 shown in FIG. 3 is a connector for a flat cable mounted on a circuit board 60, and has a housing 51 for receiving the intermediate member 12 of the electric wire connection structure 10 and a contact 52 held in this housing 51 which contacts the contact part 122 of the received intermediate member 12. A receiving groove 512 for receiving the intermediate member 12 is opened on the contact surface 511 that faces the coupler 13, and at both sides of the receiving groove 512 are formed two guide holes (not illustrated) in which the guide pins 132 are inserted. The contact 52 is held inside the receiving groove 512. Also, in the housing 51 of the connector 50 is formed a lock arm 513 that engages with the lock unit 153.

When the individual electric wires 11 are connected to the mating connector 50, the guide pins 132 of the coupler 13 are first inserted in the guide hole of the mating connector 50. Then, the coupler 13 has the connector contact surface 131 pressed until it reaches the contact surface 511 of the housing 51. At this time, the contact part 122 of the intermediate member 12 is guided by the guide pins 132 of the coupler 13 and received at the mating connector 50, and makes contact with the contact 52. By doing this, the individual electric wires 11 connected to the electric wire connecting part 123 and the contact 52 of the mating connector 50 are electrically connected by the intermediate member 12. Also, at this time, the lock arm 513 of the mating connector 50 extends through the lock hole 153*a* (see FIG. 1 part (c)), and engages with the lock unit 153. Therefore, even when oscillation or the like is applied, it is possible to prevent the individual electric wires 11 from falling out of the mating connector 50.

In this way, with the electric wire connection structure 10 of this embodiment, the constitution is such that the plate-shaped intermediate member 12 is grasped by the coupler 13, so the contact part 122 of the intermediate member 12 is received in the mating connector 50 and contacts the contact 52, just as in the case of a flat cable. Therefore, with the electric wire connection structure 10 of this embodiment, it is possible to collectively connect the plurality of individual electric wires 11 to the mating connector 50 for the flat cable without requiring a dedicated terminal connected to the individual electric wires 11. Also, with the mating connector 50, there is no need to make changes for the individual electric wire connection, so there is no hindrance to later again connecting a flat cable 81 constituting the prior art flat cable connection structure 80 shown in FIG. 9, for example.

Next, a second embodiment of the present invention will be described. With the description of the second embodiment below, the same reference numerals are given to the same elements as the elements of the embodiment described up to now, and the points that differ from the previously-described embodiment are described.

Figure 5:
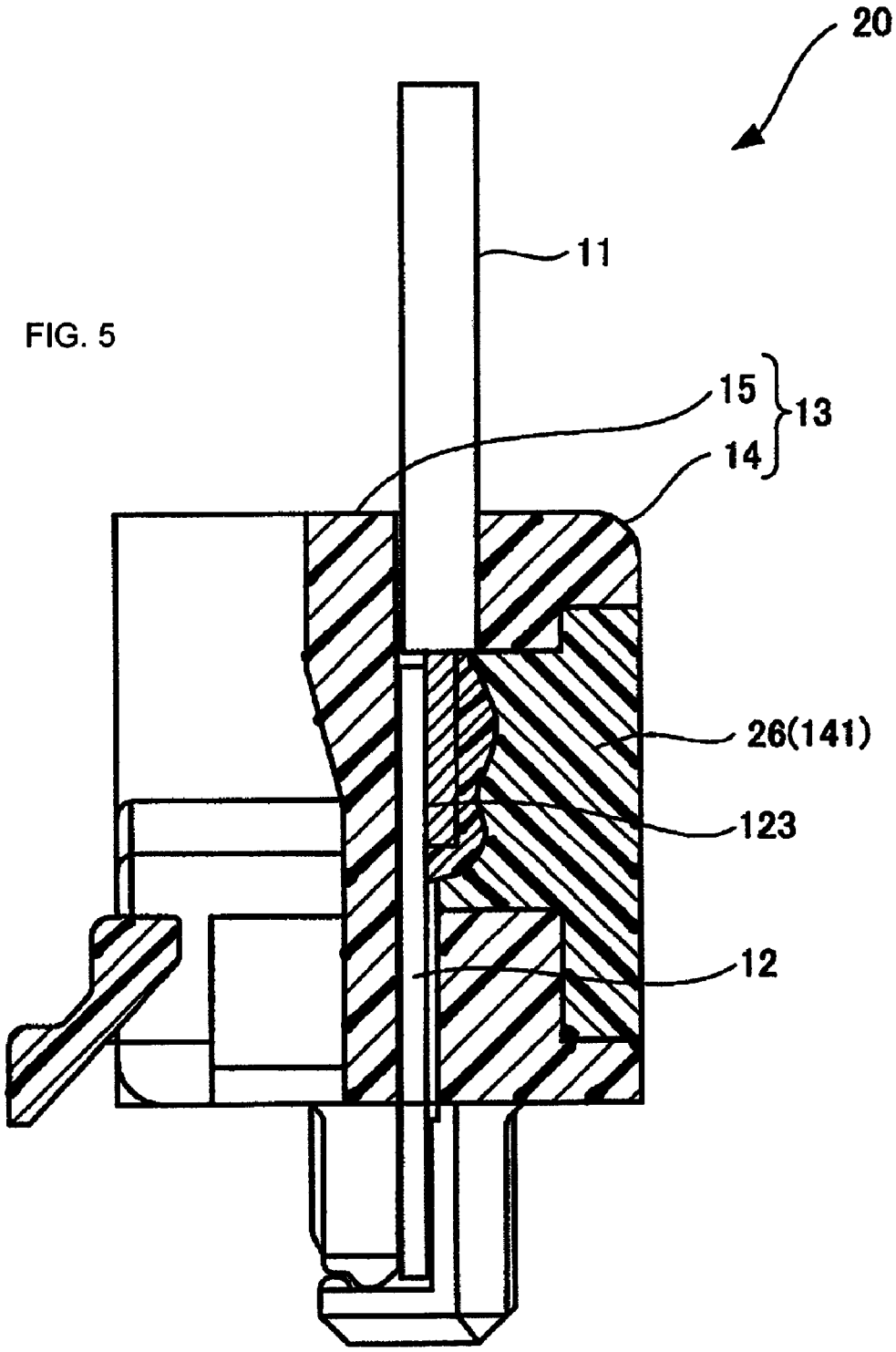
FIG. 5 is the A-A cross section of FIG. 4B.

FIGS. 4A-E are external views showing the electric wire connection structure 10 of the second embodiment of the present invention, and FIG. 5 is the A-A cross section of FIG. 4B.

Just as in the arrangement in FIG. 1, FIG. 4A shows a plan view of the electric wire connection structure 20, FIG. 4B shows a front view, FIG. 4C shows a bottom view, FIG. 4D shows a rear view, and FIG. 4E shows the right-side view.

The electric wire connection structure 20 differs from the electric wire connection structure 10 shown in FIG. 1 in that a mold unit 26 is added. The mold unit 26 is a so-called overmold, and is formed with insulative material that embeds the hole 141 of the coupler 13 and surrounds part of the coupler 13.

With the electric wire connection structure 20, the coupler 13 grasps the intermediate member 12 while avoiding the electric wire connecting part 123, so the stress applied to the connection part of the individual electric wires 11 and the intermediate member 12 is relieved, and furthermore, with the insulative material that embeds the hole 141, the part connected by solder is protected from the outside.

The electric wire connection structure 20 is built by having the coupler 13 of the electric wire connection structure 10 shown in FIG. 1 set into predetermined dies 200, the insulative material injected inside the dies 200 interior flows into the space between the coupler 13 and the dies 200, and after this, the insulative material hardens and becomes the mold unit 26.

Figure 6:
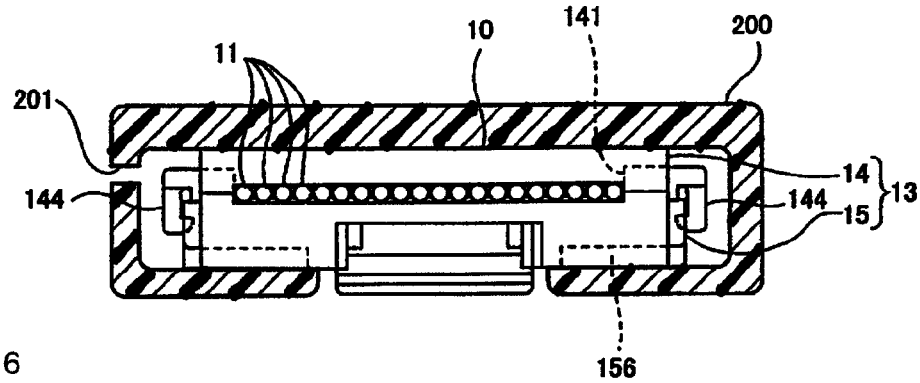
FIG. 6 is a cross sectional view showing the state with the coupler of the electric wire connection structure of FIGS. 1 A-E set into the molding dies.

FIG. 6 is a schematic view showing the state of the coupler of the electric wire connection structure of FIG. 1 being set into the molding dies 200.

FIG. 6 shows the cross section of the dies 200 in which the coupler 13 of the electric wire connection structure 10 is set. An injection port 201 is formed on the dies 200, and molten material such as epoxy resin, for example, is injected inside the dies 200 from this injection port 201. The injected material flows into the space between the dies 200 and the coupler 13, and mainly flows into the side part of the periphery of the engaging piece 144 of the coupler 13, the hole 141, and the concave part 156 formed on the second coupler member 15. The material that flows into the hole 141 embeds the hole 141. Here, the individual electric wires 11 are grasped by the first coupler member 14 and the second coupler member 15, and the material that flows into the hole 141 is dammed by the first coupler member 14 and the second coupler member 15, so it does not protrude from the periphery of the individual electric wires 11.

If there is a case when the individual electric wires 11 are not grasped by the first coupler member 14 and the second coupler member 15, it is necessary to directly grasp the individual electric wires 11 with the dies 200, but in this case, the material that flows from the injection port to inside the dies 200 can easily protrude from between the dies 200 and the individual electric wires 11 or from between the individual electric wires 11. On the one hand, with the electric wire connection structure 20 of this embodiment, the insulative material is dammed by the first coupler member 14 and the second coupler member 15, so there is no need for a countermeasure for protrusion of this insulative material with the manufacturing process. Thus, it is easy to build an electric wire connection structure 20 without protrusion of the insulative material at the periphery of the individual electric wires 11.

With the second embodiment described above, the electric wire connection structure 20 containing a so-called overmold made by insulative material that embeds the hole 141 of the coupler 13 has been described, but here, the level at which the coupler 13 is taken up by the overmold is not limited to that shown in FIG. 5. In the following, a variation example of the second embodiment for which the level at which the coupler 13 is taken up by the overmold differs from that of the electric wire connection structure 20 of the second embodiment shown in FIG. 5 will be described.

Figure 7:
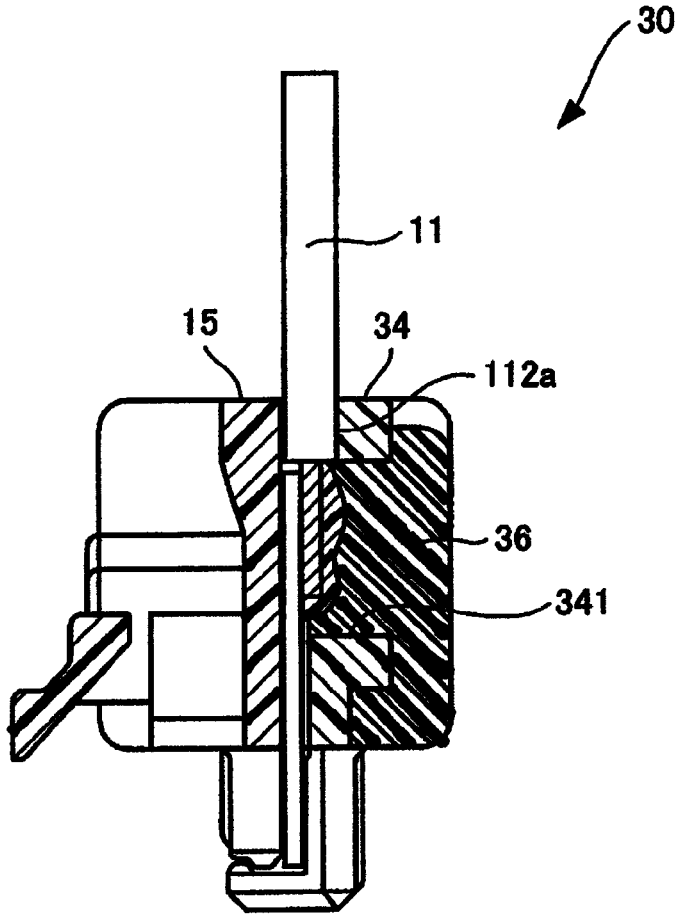
FIG. 7 is a cross sectional view showing a variation example of the electric wire connection structure of FIG. 5.

FIG. 7 shows a variation example of the electric wire connection structure 10 of FIG. 5.

With the electric wire connection structure 30 shown in FIG. 7, the height in the direction in which the hole 341 of the first coupler member 34 is penetrated is lower than the case of the electric wire connection structure 20 of FIG. 5, and because of this, the entire upper surface of the first coupler member 34 is covered by the mold unit 36.

With this electric wire connection structure 30 as well, the insulative material that flows into the hole 341 of the first coupler member 34 is dammed by the first coupler member 34 and the second coupler member 15, so there is no protrusion to the periphery of the individual electric wires 11.

Next, a third embodiment of the present invention will be described. With the description of the third embodiment below, the same reference numerals are given to the same elements as the elements of the embodiments described up to now, and the points that differ from the previously described embodiments are described.

Figure 8:
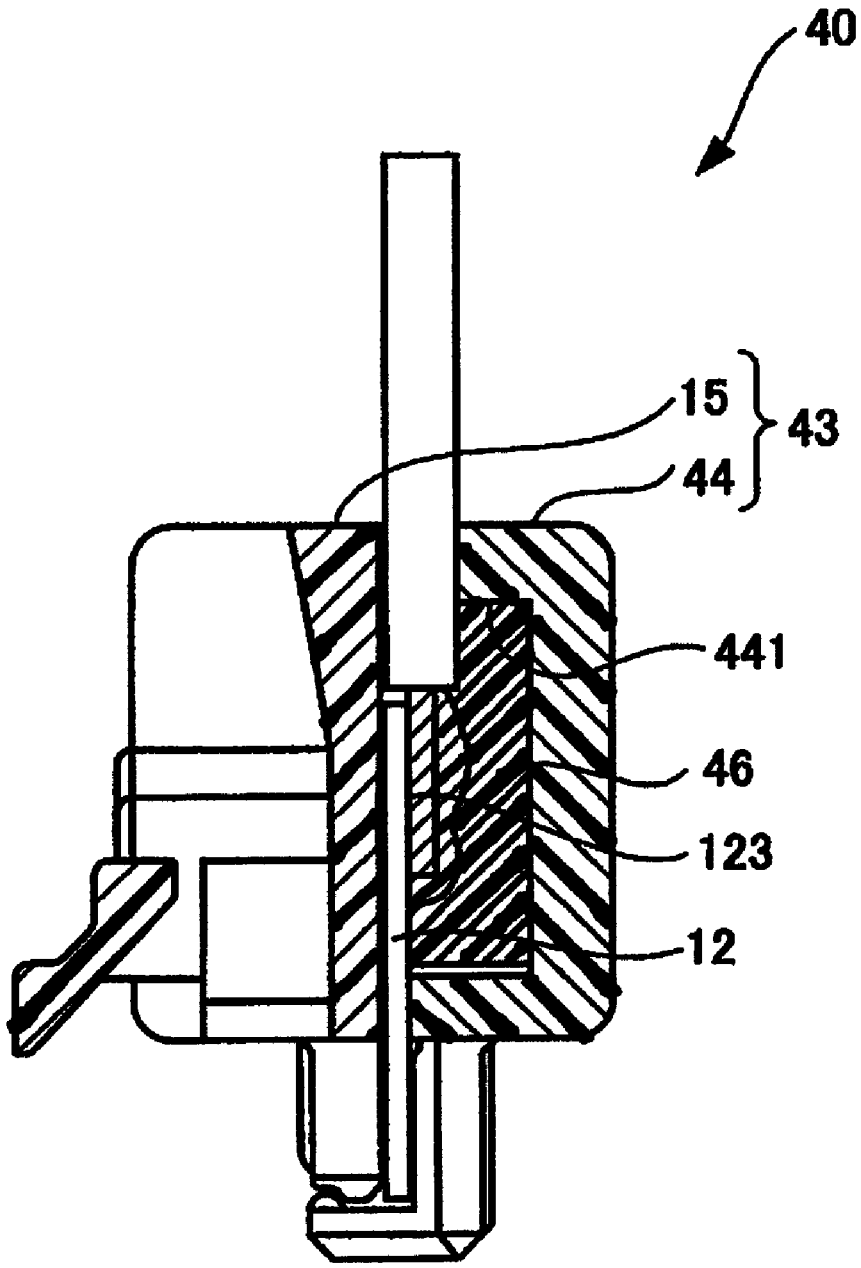
FIG. 8 is a cross sectional view showing the electric wire connection structure of the third embodiment of the present invention; and, FIG. 9 is a cross section showing the flat cable connection structure of the prior art.

FIG. 8 is a cross section showing the electric wire connection structure of the third embodiment of the present invention.

The electric wire connection structure 40 shown in FIG. 8 is built by so-called potting, and the differences from the electric wire connection structure 10 of the first embodiment shown in FIG. 1 are the points that the coupler 43 is equipped with a concave part 441 instead of the hole 141, and the concave part 441 is filled with the filler 46.

The concave part 441 is formed on the side facing the electric wire connecting part 123 of the first coupler member 44.

The electric connection structure 40 is built by having a gel-type filler 46 consisting of epoxy resin or the like, for example, placed so as to cover the individual electric wires 11 on the intermediate member 12 to which the individual electric wires 11 are soldered, and next, by the intermediate member 12 being grasped by the first coupler member 14 and the second coupler member 15.

With the electric wire connection structure 40 of this embodiment, the coupler 13 grasps the intermediate member 12 while avoiding the electric wire connecting part 123, so the stress on the connecting part of the individual electric wires 11 and the intermediate member 12 is relieved, and furthermore, with the filler 46 filled in the concave part 441, there is a decrease in the risk of corrosion due to contact of the connection part with air, and of contact between adjacent electric wires.

Note that with the electric wire connection structure 40, the filler 46 filling the concave part 441 has been described, but the present invention is not limited to this, and it is also possible to have the inside of the concave part 156 be hollow, for example. However, by filling with filler, there is a decrease in the risk of corrosion due to contact of the connection part with air, and of contact between adjacent electric wires.

Also, with the embodiment described above, the number of individual electric wires 11 was twenty, and we described the number of the electric wire connecting parts and the wiring patterns 121 on which the contact parts are formed as being twenty corresponding to the individual electric wires 11, but the present invention is not limited to this, and the number of individual electric wires 11 as well as the number of electric wire connecting parts and contact parts can be a number other than twenty.

Also, with the embodiments described above, the individual electric wires 11 as being connected by solder to the intermediate member 12 have been described, but the present invention is not limited to this, and, for example, it is also possible to have a constitution in which a fixing bracket is provided on the intermediate member 12, and the individual electric wires 11 are connected to this fixing bracket by pressure welding or the like. However, with a solder connection, it is possible to connect a plurality of individual electric wires to the intermediate member 12 all at once.

What is claimed is:

1. An electric wire connection structure for collectively connecting to a mating connector for a flat cable, comprising:

a plurality of individual electric wires arranged in a row, a plate-shaped intermediate member which has an electric wire connecting part to which the respective ends of the plurality of individual electric wires are connected, and a contact part received by the mating connector, a coupler having first and second coupler members that grasps the intermediate member to which the plurality of individual electric wires are connected, for guiding the intermediate member to a predetermined position of the mating connector, and a hole piercing the first coupler member and formed on a side facing the electric wire connecting part.

2. The electric wire connection structure in accordance with claim 1, wherein the coupler grasps the end part of the insulation covering of the individual electric wires.

3. The electric wire connection structure in accordance with claim 2, wherein the individual electric wires are connected by solder to the electric wire connecting part.

4. The electric wire connection structure in accordance with claim 1, wherein the electric wire connection structure further comprises a mold unit consisting of an insulative material that embeds the hole.

5. The electric wire connection structure in accordance with claim 1, wherein the coupler further comprises a lock unit for engaging with the mating connector.

* * * * *